US011053937B2

(12) United States Patent
Tsukamoto

(10) Patent No.: US 11,053,937 B2
(45) Date of Patent: Jul. 6, 2021

(54) CURVED FLEXIBLE IMPELLER

(71) Applicant: NOK CORPORATION, Tokyo (JP)

(72) Inventor: Koji Tsukamoto, Makinohara (JP)

(73) Assignee: NOK CORPORATION

( * ) Notice: Subject to any disclaimer, the term of this patent is extended or adjusted under 35 U.S.C. 154(b) by 271 days.

(21) Appl. No.: 16/342,896

(22) PCT Filed: Oct. 5, 2017

(86) PCT No.: PCT/JP2017/036254
§ 371 (c)(1),
(2) Date: Apr. 17, 2019

(87) PCT Pub. No.: WO2018/088077
PCT Pub. Date: May 17, 2018

(65) Prior Publication Data

US 2019/0242379 A1 Aug. 8, 2019

(30) Foreign Application Priority Data

Nov. 8, 2016 (JP) ..... JP2016-218154

(51) Int. Cl.
*F04C 5/00* (2006.01)
*F01C 5/02* (2006.01)

(52) U.S. Cl.
CPC ..... *F04C 5/00* (2013.01); *F01C 5/02* (2013.01); *F04C 2250/20* (2013.01); *F05C 2225/02* (2013.01)

(58) Field of Classification Search
CPC .... F04C 2250/20; F04C 5/00; F05C 2225/02; F01C 5/02
See application file for complete search history.

(56) References Cited

U.S. PATENT DOCUMENTS 2,466,440 A 4/1949 Kiekhaefer
2,772,637 A 12/1956 Doble
(Continued)

FOREIGN PATENT DOCUMENTS

CN 103629151 A 3/2014
DE 808 914 C 7/1951
(Continued)

OTHER PUBLICATIONS

Extended European Search Report for Application No. EP 17 86 9413 dated Aug. 13, 2019 (6 pages).

*Primary Examiner* — Mary Davis
(74) *Attorney, Agent, or Firm* — Harness, Dickey & Pierce, P.L.C.

(57) ABSTRACT

An impeller is attached to a rotary shaft provided in an inner space of a housing and includes a tube fixed to the rotary shaft and a plurality of blades protruding toward an outer diameter direction from the tube. A tip of each blade is in slidable contact with an inner peripheral surface of the housing. Each blade has a shape curved toward a rotation-direction rear side of the rotary shaft in a free state and includes an extension surface on a rotation-direction front side of the rotary shaft and a compression surface on the rotation-direction rear side of the rotary shaft. A curvature radius of a root on the compression surface in the blade is formed larger than a curvature radius of a root on the extension surface in the blade.

2 Claims, 8 Drawing Sheets

(56) References Cited

U.S. PATENT DOCUMENTS

| | | | | |
|---|---|---|---|---|
| 3,053,190 | A * | 9/1962 | Carlson | F04C 5/00 418/154 |
| 3,832,105 | A | 8/1974 | Takahashi | |
| 4,718,837 | A * | 1/1988 | Frazzell | F04C 5/00 418/154 |
| 2014/0056734 | A1 | 2/2014 | Yamauchi | |

FOREIGN PATENT DOCUMENTS

| | | | |
|---|---|---|---|
| EP | 2333236 | A1 | 6/2011 |
| JP | S49-142604 | U | 12/1974 |
| JP | S52-075102 | U | 6/1977 |
| JP | S63-010281 | U | 1/1988 |
| JP | S63-186981 | A | 8/1988 |
| JP | H05-010799 | U | 2/1993 |
| JP | H05-306687 | A | 11/1993 |

* cited by examiner

CURVED FLEXIBLE IMPELLER

CROSS REFERENCE TO RELATED APPLICATIONS

This application is a U.S. National Stage application of International Application No. PCT/JP2017/036254 filed on Oct. 5, 2017 and published in Japanese as WO 2018/088077 on May 17, 2018 and claims priority to Japanese Patent Application No. 2016-218154 filed on Nov. 8, 2016. The entire disclosures of the above applications are expressly incorporated by reference herein.

BACKGROUND

Technical Field

The present invention relates to an impeller used for a pump device.

Related Art

In the prior art, an impeller 510 used for a pump device or the like is known as illustrated in FIGS. 6 and 7. The impeller 510 is provided with a tube 520 attached to a rotary shaft 550 inserted through a shaft hole 542 of a housing 540 and a plurality of blades 530 protruding toward an outer diameter direction from the tube 520. The blade 530 is made of a rubber-shaped elastic body and has a radial linear shape in the free state that is illustrated in FIGS. 6 and 7A. In the mounting state that is illustrated in FIG. 7B, a tip 531 of the blade 530 is in slidable contact with an inner peripheral surface 541 of the housing 540.

As illustrated in FIG. 7B, the impeller 510 is attached to the rotary shaft 550 eccentric to the inner peripheral surface 541 of the housing 540 while bending the blade 530 to a rotation-direction rear side B. Then, by the rotary shaft 550 rotating to a rotation-direction front side A, the blade 530 slides with the inner peripheral surface 541 of the housing 540. A liquid can be transferred from a pump suction port to a pump discharge port by means of the volume change in the space between a blade 530*a* and an adjacent blade 530*b* that results from the sliding.

As illustrated in FIG. 6, in the impeller 510 configured as described above, the blade 530 has a radial linear shape in the free state and the rotary shaft 550 is eccentric to the inner peripheral surface 541 of the housing 540. Accordingly, deformation of the blade 530 becomes particularly large at the circumferential position where the radial width between the rotary shaft 550 and the inner peripheral surface 541 of the housing 540 is minimized. Therefore, as illustrated in FIG. 7B, a wrinkle X is generated due to the strain concentration in the root of the blade 530. As the wrinkle X expands, a repulsive force to the inner peripheral surface 541 of the housing 540 decreases, and then a large crack arises. A decline in pump discharge performance and division of the blade 530 may arise as a result.

In this regard, it is conceivable to mitigate the strain concentration in the blade 530 by reducing the thickness of the blade 530 as illustrated in FIG. 8. However, once the thickness of the blade 530 is reduced (see FIG. 8A) with respect to the blade 530 in FIG. 7A for wrinkling prevention, a decrease in the rigidity of the blade 530 results in significant bending X' (see FIG. 8B) in the root of the blade 530, and then the blade 530 may be separated from the inner peripheral surface 541 of the housing 540.

The present invention has been made in view of the above-described problems, and a technical object of the present invention is to provide an impeller with which wrinkling of a blade attributable to strain concentration can be prevented and a repulsive force with respect to a housing of the blade can be ensured.

SUMMARY OF THE INVENTION

In order to solve the above technical problem, an impeller of the present invention attached to a rotary shaft provided in an inner space of a housing includes a tube fixed to the rotary shaft and a blade protruding toward an outer diameter direction from the tube, a tip of the blade being in slidable contact with an inner peripheral surface of the housing. The blade has a shape curved toward a rotation-direction rear side of the rotary shaft in a free state and includes an extension surface on a rotation-direction front side of the rotary shaft and a compression surface on the rotation-direction rear side of the rotary shaft. A curvature radius of a root on the compression surface in the blade is formed larger than a curvature radius of a root on the extension surface in the blade.

In addition, an impeller of the present invention attached to a rotary shaft provided in an inner space of a housing includes a tube fixed to the rotary shaft and a blade protruding toward an outer diameter direction from the tube, a tip of the blade being in slidable contact with an inner peripheral surface of the housing. The blade has a shape curved toward a rotation-direction rear side of the rotary shaft in a free state and includes an extension surface on a rotation-direction front side of the rotary shaft and a compression surface on the rotation-direction rear side of the rotary shaft. The blade has a radial length of 9 to 15 mm. A relationship of $R_{11}=0.1W_1$ to $0.5W_1$ is satisfied with $W_1$ representing the radial length of the blade and $R_{11}$ representing a curvature radius of a root on the extension surface in the blade. A relationship of $R_{12}=0.1W_1$ to $0.5W_1$ is satisfied with $W_1$ representing the radial length of the blade and $R_{12}$ representing a curvature radius of a root on the compression surface in the blade. A relationship of $R_{13}=0.5W_1$ to $1.0W_1$ is satisfied with $W_1$ representing the radial length of the blade and $R_{13}$ representing a curvature radius of a radial midsection on the compression surface in the blade. A relationship of $R_{14}=2W_1$ to $6W_1$ is satisfied with $W_1$ representing the radial length of the blade and $R_{14}$ representing a curvature radius of a radial midsection on the extension surface in the blade. An inclination angle $\theta_1$ of the extension surface near the tip of the blade with respect to an impeller diameter line is set to 4 to 9 degrees. An inclination angle $\theta_2$ of the compression surface near the tip of the blade with respect to the impeller diameter line is set to 5 to 10 degrees.

Effect of the Invention

In the impeller of the present invention, the blade is curved in advance so as to easily bend and the curvature radius of the root on the compression surface is formed large. Accordingly, wrinkling of the blade attributable to strain concentration can be prevented and it is possible to ensure a repulsive force with respect to the housing of the blade.

Wrinkling of the blade attributable to strain concentration can be prevented and it is possible to ensure the repulsive force with respect to the housing of the blade even with regard to the blade of the impeller in which the radial length of the blade is as small as 9 to 15 mm.

DETAILED DESCRIPTION OF THE PREFERRED EMBODIMENTS

Next, an impeller 10 according to embodiments will be described in detail with reference to accompanying drawings.

First Embodiment

Figure 1:
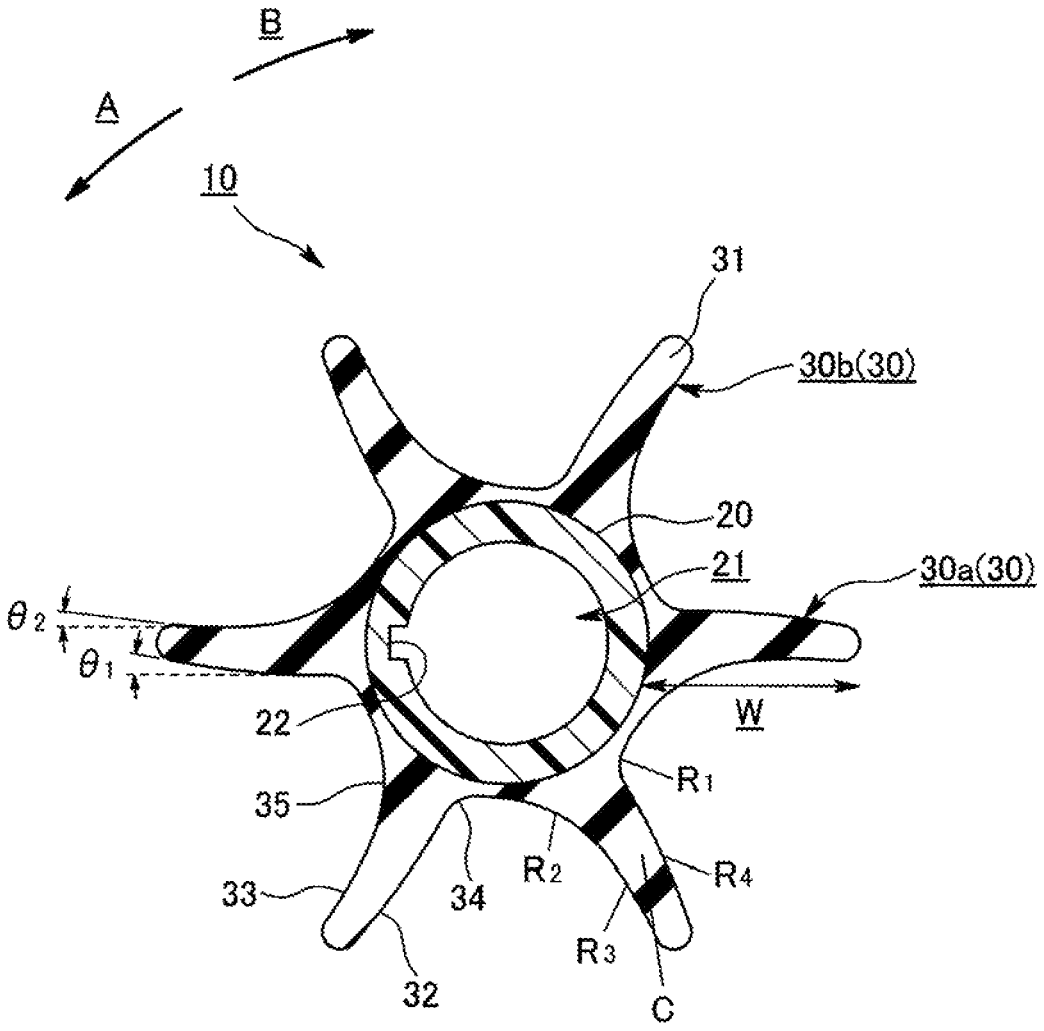
FIG. 1 is a cross-sectional view illustrating a free-state shape of an impeller according to a first embodiment of the present invention.
Figure 2:
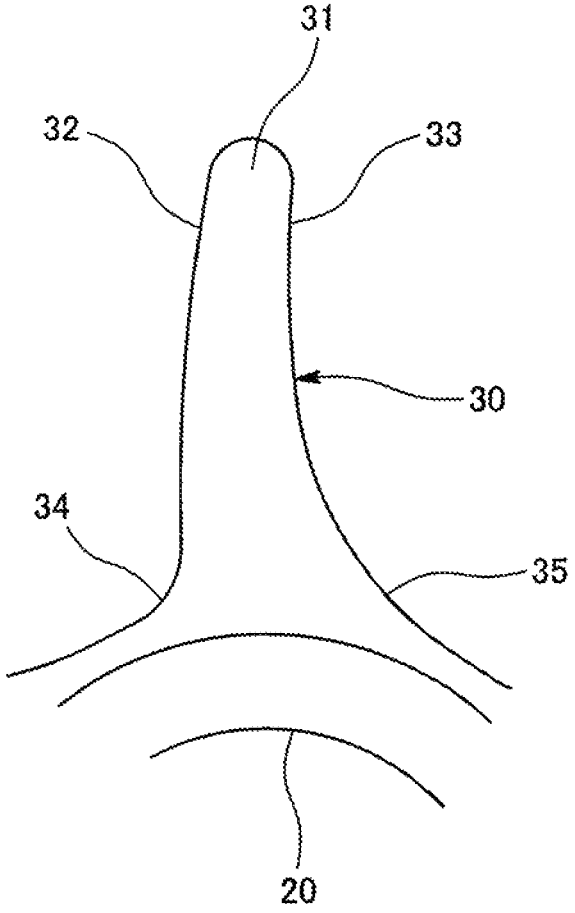
FIG. 2 is an enlarged view of a main part illustrating a blade of the impeller according to the first embodiment of the present invention.
Figure 3:
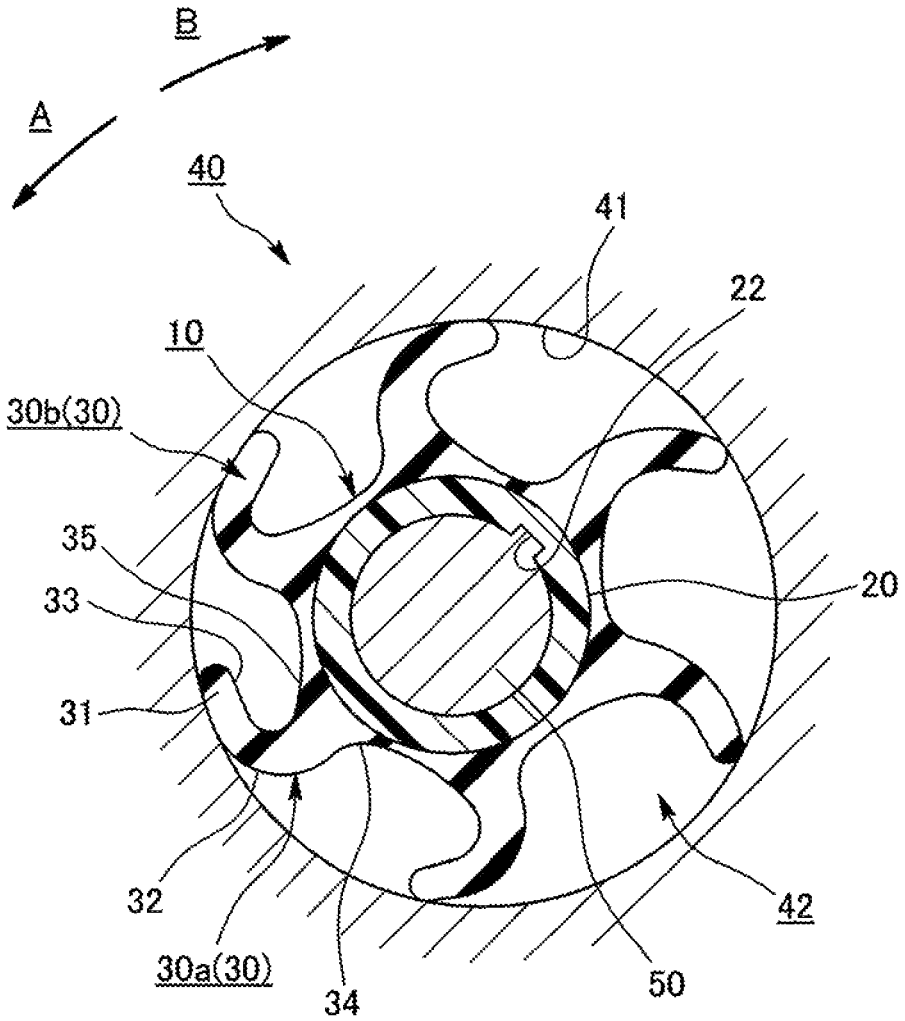
FIG. 3 is a cross-sectional view illustrating the mounting-state shape of the impeller according to the first embodiment of the present invention.

The impeller 10 according to the present embodiment is used for a pump device or the like. As illustrated in FIGS. 1 to 3, the impeller 10 is provided with an annular tube 20 fixed to a rotary shaft 50 provided in a shaft hole 42 of a housing 40 and a plurality of blades 30 protruding toward an outer diameter direction from the tube 20.

The tube 20 is made of a resin material. The tube 20 is provided with an insertion hole 21 through which the rotary shaft 50 is inserted and a notch portion 22 provided at a part on the circumference of the insertion hole 21 and fixing the rotary shaft 50.

The blade 30 is made of a rubber material such as chloroprene rubber having a hardness of Hs 50 to 70. As illustrated in FIGS. 1 to 3, the blades 30 circumferentially equally protrude from the tube 20 toward the outer diameter direction, a tip 31 is in slidable contact with an inner peripheral surface 41 of the housing 40, and the blade 30 has a shape curved to a rotation-direction rear side B of the rotary shaft 50 in a free state. An extension surface 32 and a compression surface 33 are provided in the root of the blade 30. The extension surface 32 is positioned on a rotation-direction front side A of the rotary shaft 50 and has a circular arc shape in cross section. The compression surface 33 is positioned on the rotation-direction rear side B of the rotary shaft 50 and has a circular arc shape in cross section as in the case of the extension surface 32. A curvature radius $R_2$ of a root 35 on the compression surface 33 is set larger than a curvature radius $R_1$ of a root 34 on the extension surface 32. In other words, the curvature radius $R_2$ of the compression surface 33 is set larger than the curvature radius $R_1$ of the extension surface 32.

It is preferable that the impeller 10 in the present embodiment illustrated in FIG. 1 is manufactured with the following dimensions. The impeller of the present invention is not limited to the following dimensional ranges.

A radial length W of the blade 30 is set to 20 to 30 mm. Accordingly, the impeller 10 according to the embodiment is a large impeller in which the radial length W of the blade 30 is large.

It is preferable to set $R_1$ to 0.1W to 0.4W with W representing the radial length of the blade 30 and $R_1$ representing the curvature radius of the root 34 on the extension surface 32 in the blade 30. When W is 20 to 30 mm, $R_1$ is preferably 2.5 to 10 mm and more preferably 3 to 6 mm.

It is preferable to set $R_2$ to 0.5W to 1.2W with W representing the radial length of the blade 30 and $R_2$ representing the curvature radius of the root 35 on the compression surface 33 in the blade 30. When W is 20 to 30 mm, $R_2$ is preferably 12 to 30 mm and more preferably 18 to 2

It is preferable to set $R_3$ to 0.8W to 1.8W with W representing the radial length of the blade 30 and $R_3$ representing the curvature radius of a radial midsection C on the compression surface 33 in the blade 30. When W is 20 to 30 mm, $R_3$ is preferably 20 to 45 mm and more preferably 28 to 32 mm.

It is preferable to set $R_4$ to 1W to 5W with W representing the radial length of the blade 30 and $R_4$ representing the curvature radius of the radial midsection C on the extension surface 32 in the blade 30. When W is 20 to 30 mm, $R_4$ is preferably 25 to 125 mm and more preferably 75 to 85 mm.

As for the extension surface 32 near the tip 31 of the blade 30, it is preferable to set an inclination angle $\theta_1$ with respect to the diameter line of the impeller 10 to 3 to 9 degrees. More preferably, the inclination angle $\theta_1$ is set to 6 to 8 degrees.

As for the compression surface 33 near the tip 31 of the blade 30, it is preferable to set an inclination angle $\theta_2$ with respect to the diameter line of the impeller 10 to 1 to 5 degrees. More preferably, the inclination angle $\theta_2$ is set to 1.5 to 3.5 degrees.

The impeller 10 configured as described above is attached to the rotary shaft 50 eccentric to the inner peripheral surface 41 of the housing 40. By the rotary shaft 50 rotating to the rotation-direction front side A, the blade 30 slides with the inner peripheral surface 41 of the housing 40 and the blades 30 are sequentially bent toward the rotation-direction rear side B. By the blades 30 being bent, the space between a blade 30*a* and an adjacent blade 30*b* decreases. As a result, the pressure of the liquid in the space increases and the liquid is discharged to a discharge port (not illustrated). Further, once the space between the blade 30*a* and the adjacent blade 30*b* increases by the blade 30 exerting an elastic restoring force, the pressure of the liquid in the space decreases and the liquid is suctioned into a suction port (not illustrated).

As described above, in the impeller 10 according to the present embodiment, a volume change is repeated in the space between the blade 30*a* and the adjacent blade 30*b* as the rotary shaft 50 rotates. Accordingly, the liquid can be sequentially introduced from the right side to the left side in FIG. 3.

Figure 7A:
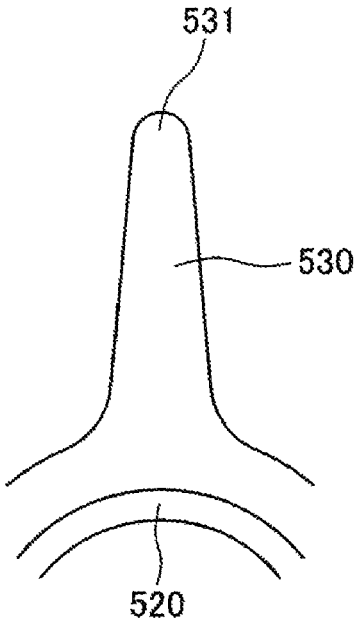
FIG. 7A Prior Art
FIG. 7A is an enlarged view of a main part illustrating a blade of the impeller according to the first prior art.
Figure 7B:
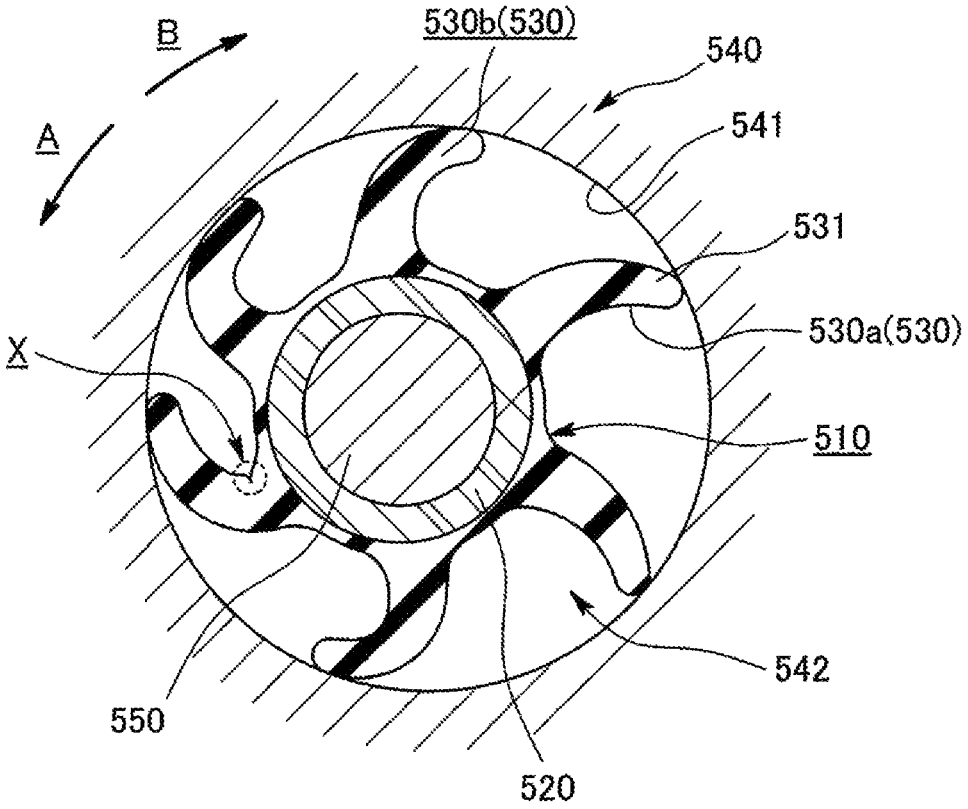
FIG. 7B Prior Art
FIG. 7B is a cross-sectional view illustrating a state where the blade of the impeller according to the first prior art is wrinkled.
Figure 8A:
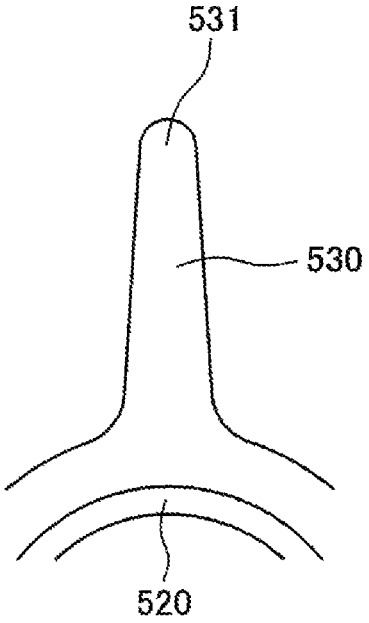
FIG. 8A Prior Art
FIG. 8A is an enlarged view of a main part illustrating a blade of an impeller according to a second prior art.
Figure 8B:
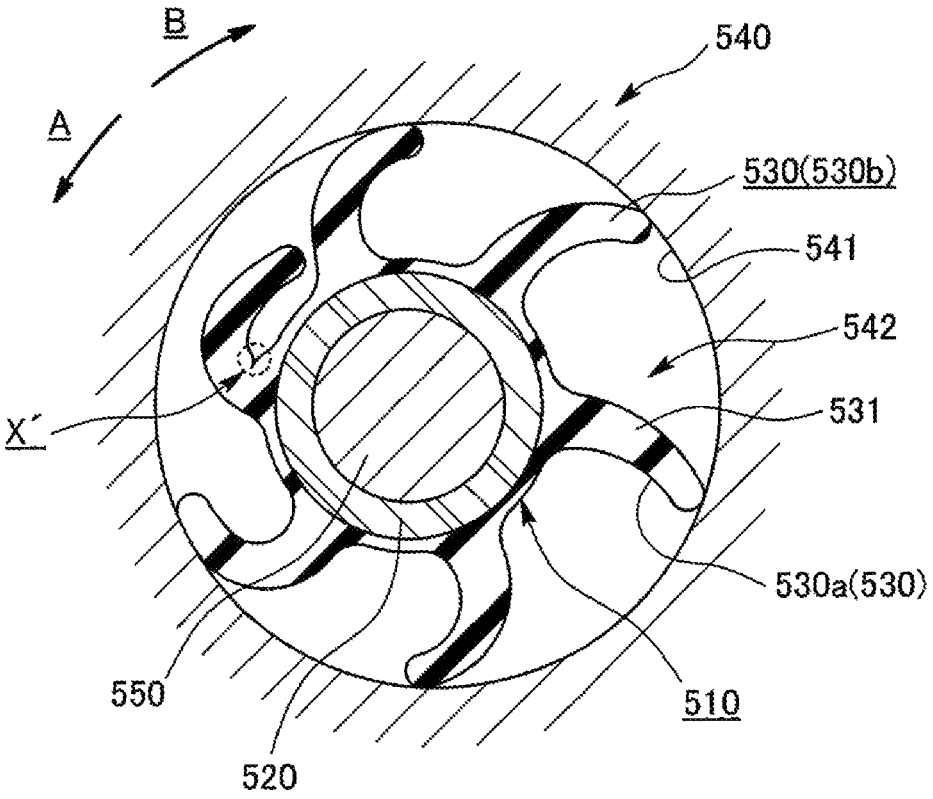
FIG. 8B Prior Art
FIG. 8B is a cross-sectional view illustrating a state where the blade of the impeller according to the second prior art is wrinkled.

As illustrated in FIG. 2, in the impeller 10 according to the present embodiment, the blade 30 has a shape curved to the rotation-direction rear side B. Accordingly, the entire blade 30 smoothly bends as compared with the blade 530 according to the prior art, which is illustrated in FIGS. 7A and 8B and has a linear shape in the free state. As a result, it is possible to improve the durability of the impeller 10 by suppressing lopsided strain concentration and preventing the blade 30 from wrinkling.

In the impeller 10 according to the present embodiment, the curvature radius $R_2$ of the root 35 on the compression surface 33 in the blade 30 is set larger than the curvature radius $R_1$ of the root 34 on the extension surface 32. Accordingly, the blade 30 is incapable of bending to the rotation-direction rear side B beyond a required range. As a result, it is possible to ensure a certain repulsive force with respect to the housing 40 of the blade 30.

In the impeller 10 according to the present embodiment, the extension surface 32 and the compression surface 33 near the tip 31 of the blade 30 are inclined with respect to the diameter line of the impeller 10, and thus wrinkling can be further prevented.

In the impeller 10 according to the present embodiment, the blade 30 is curved in the free state, and thus the blade 30 can be easily assembled to the rotary shaft 50 provided in the housing 40.

The impeller 10 according to the present embodiment achieves the above-described action and effect simply by means of a change in the shape of the blade 30. Accordingly, the impeller 10 can be manufactured at the same cost as the impeller 510 according to the prior art.

In the impeller of the present invention, strain reduction is achieved and wrinkling of the blade becomes less likely by the wall thickness of the blade being reduced.

Second Embodiment

Figure 4:
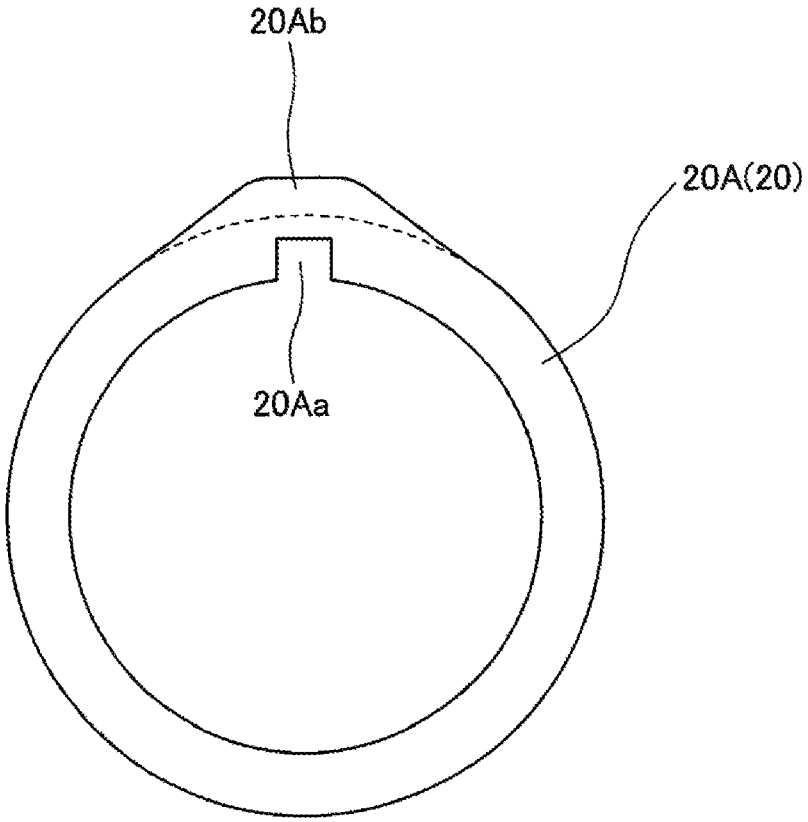
FIG. 4 is a front view of a tube provided in an impeller according to a second embodiment of the present invention.

As illustrated in FIG. 4, in the impeller 10 according to the first embodiment, the tube 20 may be a bush 20A made of, for example, a resinous or metallic rigid material. A key groove 20Aa for rotation stopping with respect to the rotary shaft 50 may be provided in one place on the circumference of the inner peripheral surface of the rigid material-based bush 20A. At the position that circumferentially corresponds to the key groove 20Aa, a raised portion 20Ab as a circumferential part may be provided on the outer peripheral surface of the position so that the part where the key groove 20Aa is provided is reinforced. In this case, all of the outer diameter dimensions of the plurality of blades 30 equally distributed on the outer peripheral side of the bush 20A are constant, and thus only a specific blade 30A at the position that circumferentially corresponds to the key groove 20Aa and the raised portion 20Ab is formed so as to have a blade length shorter than the blade length of the other blades 30.

As for the specific blade 30A, the rubber volume of the root 35 on the compression surface 33 becomes too large once the curvature radius of the root 35 on the compression surface 33 in the specific blade 30A is formed larger than the curvature radius of the root 34 on the extension surface 32 in the specific blade 30A as in the first embodiment described above. Then, the boundary position between the root 35 on the compression surface 33 and a length-direction middle portion (radial midsection) 36 in the specific blade 30A becomes a strain concentration portion and wrinkling may occur in the strain concentration portion. Even without the raised portion 20Ab being provided, the same can be said also in the case of a small impeller in which the radial length of each blade 30 is as small as approximately 9 to 15 mm.

In this regard, the following shape is preferably adopted in a case where the length of the specific blade 30A or the blade 30 is small.

Figure 5:
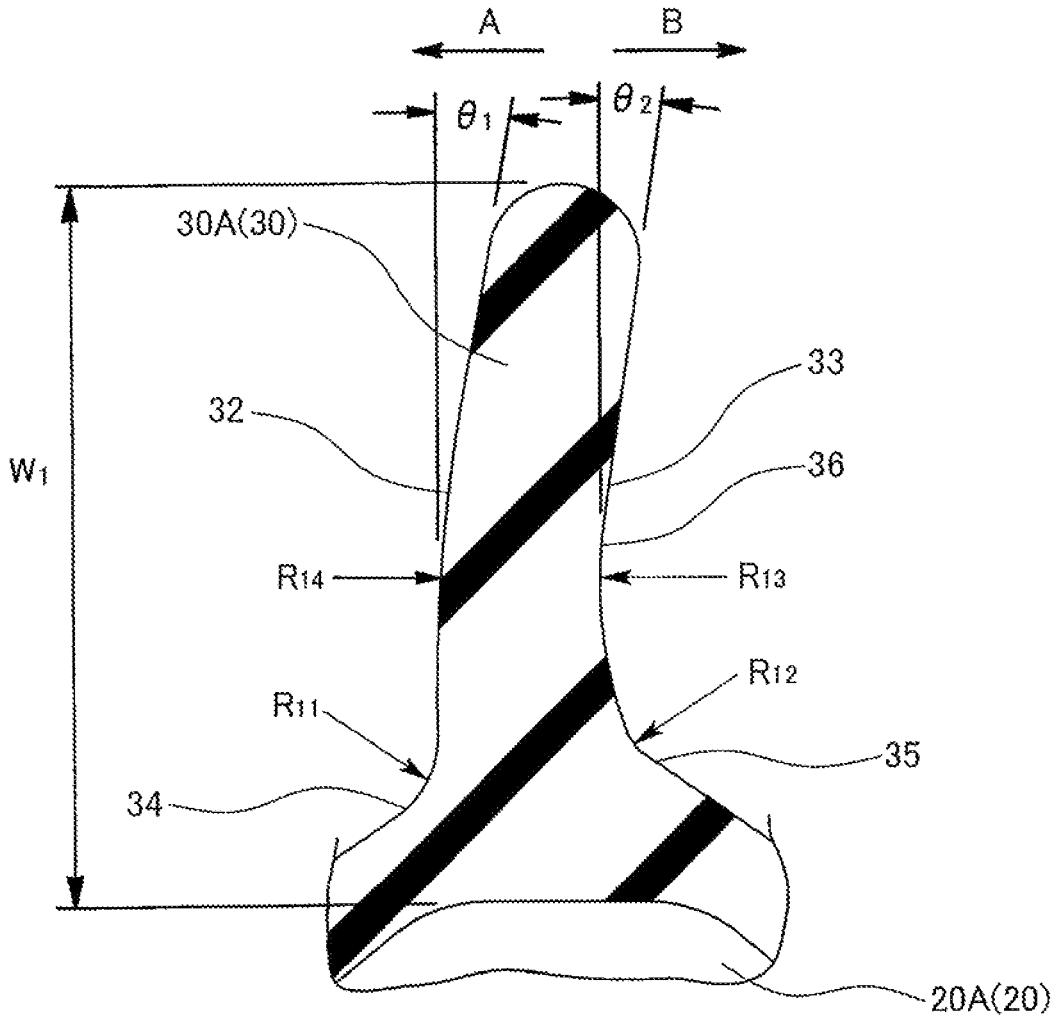
FIG. 5 is a cross-sectional view of a specific blade provided in the impeller according to the second embodiment of the present invention.
Figure 6:
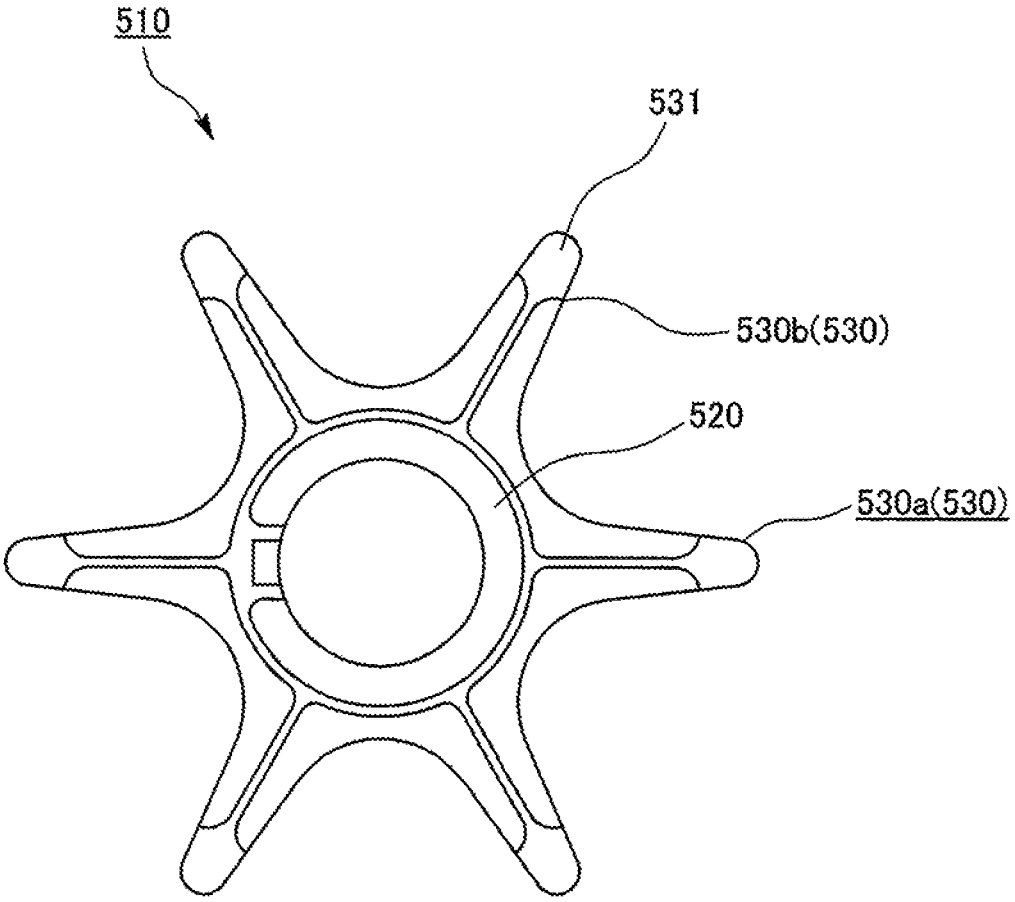
FIG. 6 Prior Art
FIG. 6 is a plan view illustrating a free-state shape of an impeller according to a first prior art.

In other words, preferable is manufacturing with the dimensions illustrated in an enlarged manner in FIG. 5. The impeller of the present invention is not limited to the following dimensional ranges.

A radial length $W_1$ of the specific blade 30A or the blade 30 is set to 9 to 15 mm as described above.

It is preferable to set $R_{11}$ to $0.1W_1$ to $0.5W_1$ with $W_1$ representing the radial length of the specific blade 30A or the blade 30 and $R_{11}$ representing the curvature radius of the root 34 on the extension surface 32 in the specific blade 30A or the blade 30. When $W_1$ is 9 to 15 mm, $R_{11}$ is preferably 1 to 5 mm.

It is preferable to set $R_{12}$ to $0.1W_1$ to $0.5W_1$ with $W_1$ representing the radial length of the specific blade 30A or the blade 30 and $R_{12}$ representing the curvature radius of the root 35 on the compression surface 33 in the specific blade 30A or the blade 30. When $W_1$ is 9 to 15 mm, $R_{12}$ is preferably 1 to 5 mm.

It is preferable to set $R_{13}$ to $0.5W_1$ to $1.0W_1$ with $W_1$ representing the radial length of the specific blade 30A or the blade 30 and $R_{13}$ representing the curvature radius of the radial midsection on the compression surface 33 in the specific blade 30A or the blade 30. When $W_1$ is 9 to 15 mm, $R_{13}$ is preferably 5 to 10 mm.

It is preferable to set $R_{14}$ to $2W_1$ to $6W_1$ with $W_1$ representing the radial length of the specific blade 30A or the blade 30 and $R_{14}$ representing the curvature radius of the radial midsection on the extension surface 32 in the specific blade 30A or the blade 30. When $W_1$ is 9 to 15 mm, $R_{14}$ is preferably 20 to 60 mm.

As for the extension surface 32 near the tip 31 of the blade 30 or the specific blade 30A, it is preferable to set the inclination angle $\theta_1$ with respect to the diameter line of the impeller 10 to 4 to 9 degrees. More preferably, the inclination angle $\theta_1$ is set to 5 to 8 degrees.

As for the compression surface 33 near the tip 31 of the blade 30 or the specific blade 30A, it is preferable to set the inclination angle $\theta_2$ with respect to the diameter line of the impeller 10 to 5 to 10 degrees. More preferably, the inclination angle $\theta_2$ is set to 7 to 10 degrees.

By each curvature dimension and inclination angle being set as described above, the strain concentration portion is disposed in the R of the length-direction middle portion 36 on the compression surface 33, the R joint in the strain concentration portion disappears, the rubber volume of the root 35 on the compression surface 33 decreases, and thus wrinkling becomes unlikely.

Accordingly, even in a case where the length of the specific blade 30A or the blade 30 is small, wrinkling attributable to strain concentration can be prevented as in the other blades 30 and it is possible to ensure a repulsive force with respect to the housing 40 of the specific blade 30A or the blade 30.

A plurality of the raised portions 20Ab may be provided on the circumference. The raised portion 20Ab may be provided at a position not corresponding to the key groove 20Aa.

The invention claimed is:

1. An impeller attached to a rotary shaft provided in an inner space of a housing, the impeller comprising:

a tube fixed to the rotary shaft; and a blade protruding toward an outer diameter direction from the tube, a tip of the blade being in slidable contact with an inner peripheral surface of the housing, wherein the blade has a shape curved toward a rotation-direction rear side of the rotary shaft in a free state and includes an extension surface on a rotation-direction front side of the rotary shaft and a compression surface on the rotation-direction rear side of the rotary shaft, and wherein a curvature radius of a root on the compression surface in the blade is formed larger than a curvature radius of a root on the extension surface in the blade.

2. The impeller according to claim 1, wherein the blade has a radial length of 9 to 15 mm, wherein a relationship of $R_{11}=0.1W_1$ to $0.5W_1$ is satisfied with Wu representing the radial length of the blade and $R_{11}$ representing the curvature radius of a root on the extension surface in the blade, wherein a relationship of $R_{13}=0.5W_1$ to $1.0W_1$ is satisfied with Wu representing the radial length of the blade and $R_{13}$ representing a curvature radius of a radial midsection on the compression surface in the blade, wherein a relationship of $R_{14}=2W_1$ to $6W_1$ is satisfied with Wu representing the radial length of the blade and $R_{14}$ representing a curvature radius of a radial midsection on the extension surface in the blade, wherein an inclination angle $\theta_1$ of the extension surface near the tip of the blade with respect to an impeller diameter line is set to 4 to 9 degrees, and wherein an inclination angle $\theta_2$ of the compression surface near the tip of the blade with respect to the impeller diameter line is set to 5 to 10 degrees.

* * * * *